US007259345B2

(12) United States Patent
Kechel

(10) Patent No.: US 7,259,345 B2
(45) Date of Patent: Aug. 21, 2007

(54) METHOD AND APPARATUS FOR SORTING AND BUNDLING MAIL

(75) Inventor: Ottmar K. Kechel, Irving, TX (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 11/025,813

(22) Filed: Dec. 29, 2004

(65) Prior Publication Data

US 2005/0125096 A1 Jun. 9, 2005

Related U.S. Application Data

(62) Division of application No. 10/077,002, filed on Feb. 15, 2002, now abandoned.

(51) Int. Cl.
*B07C 5/00* (2006.01)

(52) U.S. Cl. ..... 209/584; 209/900

(58) Field of Classification Search ..... 209/594, 209/900; 700/219, 223, 224, 225, 226; 53/443, 53/447, 493, 498, 154

See application file for complete search history.

(56) References Cited

U.S. PATENT DOCUMENTS 4,507,739 A * 3/1985 Haruki et al. ..... 700/224
5,533,318 A 7/1996 Murat ..... 53/390
5,673,193 A 9/1997 Brust et al. ..... 364/464.16
5,735,108 A 4/1998 Fuji ..... 53/540
5,901,855 A * 5/1999 Uno et al. ..... 209/584
6,219,994 B1 * 4/2001 Taniguchi ..... 53/147
6,230,872 B1 5/2001 Huang et al. ..... 198/368
6,241,460 B1 6/2001 Werner ..... 414/798.2
6,274,836 B1 * 8/2001 Walach ..... 209/584
2003/0208298 A1 11/2003 Edmonds ..... 700/224

* cited by examiner

*Primary Examiner*—Patrick Mackey
*Assistant Examiner*—Mark Hageman

(57) ABSTRACT

A method of sorting and bundling mail for delivery to a plurality of delivery points includes sorting the mail pieces in one or more passes through an automated sorting machine using destination codes associated with the mail pieces that are scanned and stored by a computer so that the mail pieces are ordered such that a final sort to a plurality of locations using at least part of the destination codes will place the mail pieces in delivery order and transferring and feeding the mail pieces to a plurality of bundling machines as a singulated stream and sorting the mail pieces to the bundling machines so that mail pieces having the same destination code are sorted to the same machine where the mail pieces are bundled by destination code for delivery.

14 Claims, 1 Drawing Sheet

METHOD AND APPARATUS FOR SORTING AND BUNDLING MAIL

This application is a divisional of U.S. Ser. No. 10/077,002, filed Feb. 15, 2002, pending.

BACKGROUND OF THE INVENTION

The United States Postal Service (USPS) delivers millions of pieces of mail on a daily basis to over a million domestic addresses. Each day, before a carrier begins to walk through or drive through his or her delivery route, it is the carrier's responsibility to put all of this mail into an appropriate sequence for efficient delivery. Under the present USPS procedure, the carrier assembles at least three delivery order sequenced stacks of mail, including letters, flats (including enveloped and non-enveloped magazines), and parcels. At each delivery stop the carrier selects the items for that address from each of the various stacks and puts them all into the postal patron's mailbox. This sorting and shuffling through various stacks of mail is time consuming, inefficient, and consequently expensive to the USPS. Consequently, any reduction in amount of hand sorting done by the carriers represents the potential for increased efficiency.

To place mail in order by destination, a Delivery Bar Code Scanner (DBCS) and/or Carrier Sequence Bar Code Scanner (CSBCS) DBCS machine is typically utilized in a multi-pass sorting scheme. Two- and three pass schemes based on significant digits of the delivery points are most common. Multi-pass sorting strategies are set forth in U.S. Pat. No. 5,363,971, the disclosure of which is incorporated herein by reference. In general, a multi-pass sort scheme starts with a disordered collection of mail and sorts the mail into intermediate batches of partially sorted mail according to a first sorting criteria. The intermediate batches are fed back into the sorter again for sorting according to a second pass sort scheme. The process may be repeated several times until the mail is sorted into delivery order, depending upon the number of available bins and the number of destination points.

The result of this sorting process is, as noted above, multiple stacks of delivery ordered mail. In order to identify, for example, letters addressed to a specific address, the carrier "thumbs" through the stack, finding the first and last item addressed to the particular delivery point and separates the letters addressed to that address from the stack. This time consuming process is repeated with the stack of flats.

The invention set forth below provides a method of reducing the amount of hand sorting and stack handling required by providing the mail to the carrier in bundles corresponding to stops on the carrier's route.

SUMMARY OF THE INVENTION

The invention provides a method for sorting and bundling mail pieces for delivery including sorting a batch of mail pieces, each having a destination code thereon which corresponds to one of a predetermined number of delivery destinations for a carrier delivery route, in one or more sorting passes with an automated sorting machine. The automated sorting machine scans and stores each delivery code in a computer memory and stores the number of mail pieces having the same destination code. The batch of mail pieces from the automated sorting machine is output in order by delivery destination, transferred to one or more bundling machines and bundled for delivery to destinations based upon the number of mail pieces stored by the computer for delivery to each destination. In one aspect, each delivery point corresponds to a ZIP code plus additional digits such as the currently used ZIP+4 code. In a similar aspect the mail pieces are sorted using one or more selected digits of destination code.

In another aspect, a method for sorting and bundling mail pieces for delivery includes: a) sorting a batch of mail pieces each having a destination code thereon which corresponds to one of n predetermined delivery destinations with an automated sorting machine which scans and stores each destination code in a computer memory in a first pass of the mail pieces through the sorting machine, the automated sorting machine ordering the mail pieces according to a first selected destination criteria, and b) sorting the batch of mail pieces to a plurality of b bundling machines by destination code whereupon mail pieces having the same destination code are directed to one of the bundling machines and bundled together in the bundling machine. In this aspect the method further comprising sorting the mail pieces in a plurality of sorting passes through the machine.

In another aspect the method includes transferring the partially sorted mail pieces from the automated feeder after the plurality of sorting passes is completed, feeding the mail pieces to a plurality of bundling machines as a singulated stream, sorting the mail pieces to individual bundling machines and bundling mail pieces with the same destination code together.

In yet another aspect, the automated sorting machine sorts the mail pieces to m bins in a plurality of p sorting passes and the number of bundling machines used to bundle the mail pieces is greater than or equal to n divided by the quantity m raised to the power p.

In another variation, the method for sorting and bundling mail pieces includes the steps of: a) sorting a batch of mail pieces each having a destination code thereon which corresponds to one of n predetermined delivery destinations in a carrier delivery route using an automated sorting machine which scans and stores each destination code in a computer memory in a first pass of the mail pieces through the sorting machine, the automated sorting machine sorting the mail pieces to a plurality of m bins using a first selected criteria corresponding to at least part of a code identifying a delivery destination in the first pass, b) sorting the mail pieces in at least one additional sorting pass through the automated sorting machine, the automated sorting machine using a different selected criteria corresponding to a least part of a code identifying a delivery destination in each additional sorting pass, c) transferring the mail pieces to a plurality of bundling machines, the batch of mail pieces being partially ordered by destination code such that a final sort to b locations using at least part of a code identifying a delivery destination will place the mail pieces in delivery order, and d) sorting the mail pieces to at least b of the bundling machines using a selected criteria corresponding to at least part of a code identifying a delivery destination whereupon mail pieces having the same destination code are directed to one of the bundling machines and bundled together in the bundling machine.

In this aspect, the part of the code used to sort the mail pieces to the bundling machines is different from the parts of the code used to sort the mail pieces in steps a) and b). The destination code may be a ZIP code plus additional digits which identifies the destination and one or more selected digits of the code are used in the first and additional sorting passes to sort the mail to the bins. One or more different selected digits of the code not used in the sorting passes are then used to sort the mail pieces to the bundling machines such that the mail pieces are grouped and bundled by destination code.

In another aspect, the mail pieces are scanned and a destination code read from each of the mail pieces as the mail pieces are sorted to the bundling machines.

In one variation, the method further comprising delivering the bundled mail to the delivery destinations. In this respect, the invention alleviates the need for the carrier to thumb or shuffle through a loose stack of mail pieces to separate mail pieces addressed to individual delivery points.

These and other aspects of the invention are described and illustrated in the detailed description and drawings.

DETAILED DESCRIPTION

Figure 1:
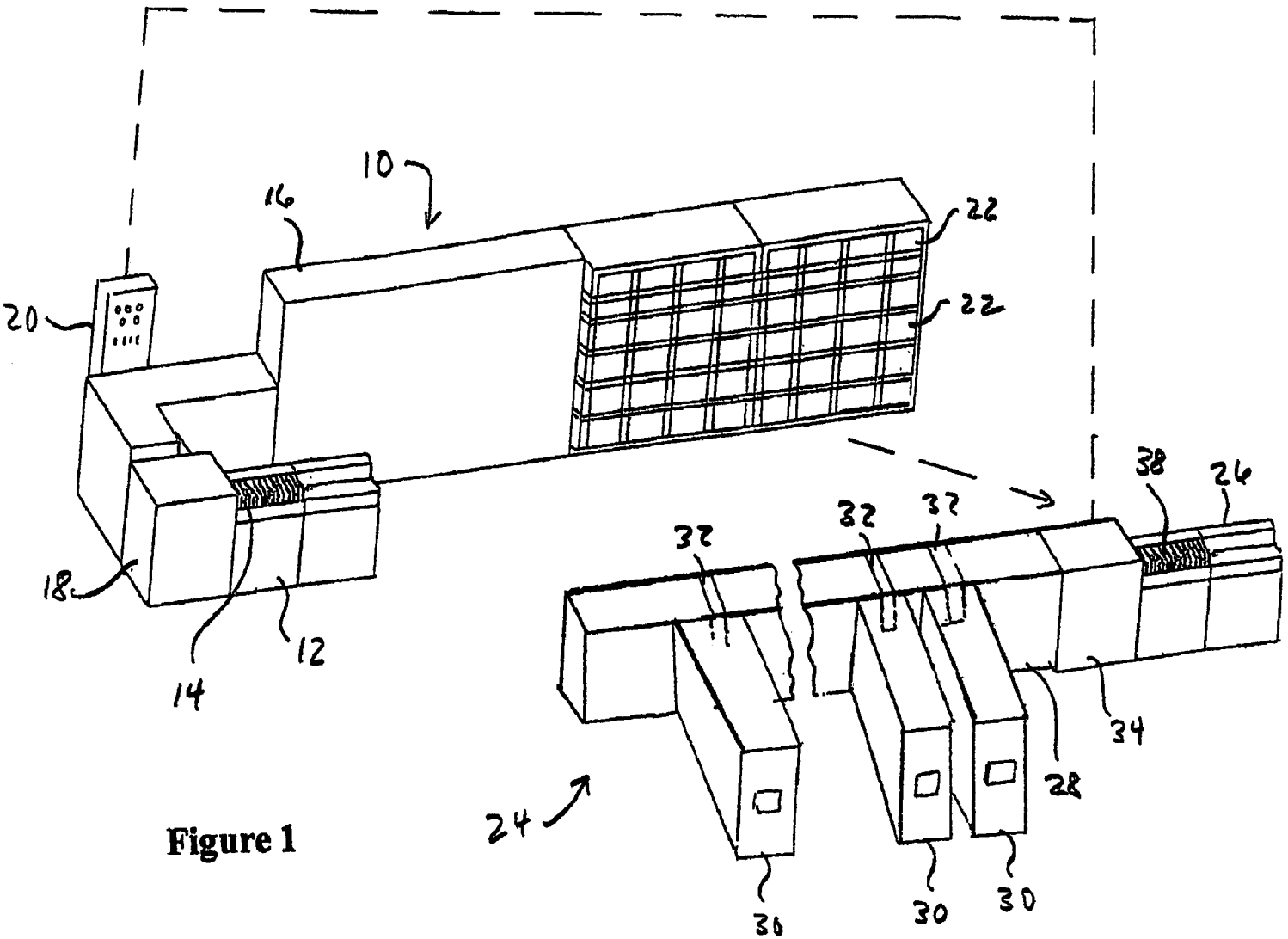
FIG. 1 is a schematic representation of an apparatus suitable for implementing a method in accordance with the invention including an automated mail sorting machine and a plurality of bundling machines.

In known sorting schemes, a multiple pass sorting scheme is typically used to maximize equipment utilization. In such a method, a feeder singulates and passes mail pieces to a scanner where destination indicia is read from the mail piece. The mail pieces are then conveyed to a series of diverters which divert individual mail pieces into bins or pockets based upon a scanned indicia such as a Zip+4 or similar code corresponding to the delivery point to which the mail piece is addressed. The stacks of mail from the individual bins are then manually or mechanically collected in sequence and replaced in the feeder for another pass through the sorter. Depending upon the number of available bins and number of destination points, the mail may be routed through the sorter for multiple passes, during which the mail is sorted into the bins based upon a sequential selected portion of the scanned indica. The process may be repeated a number of times, depending upon the level of the sort, i.e. national, regional or local, the number of destinations and the equipment used for sorting.

As is known in the art, the number of destinations or categories into which items can be sorted using a multi-pass scheme is equal to the number of bins raised to the number of passes. Thus, for example, in the case of a typical carrier delivery route, containing approximately 1000 destinations, in order to sequentially sort mail for the route with two passes, a 32 bin sorter is required ($32^2$=1024).

To illustrate the process, it is assumed that mail is to be sorted to 40,000 destinations in a conventional two pass scheme. The mail is to be delivered to 200 streets, ($S_1$–$S_{200}$) with 200 addresses ($A_1$–$A_{200}$) on each street. A possible sorting scheme to sequence the mail for delivery in this scenario could use for example, a two hundred bin sorter in a two pass sorting scheme, ($200^2$=40,000). If a lesser number of bins are available, more passes are required. Thus, if the available sorter had only thirty-five bins, three passes ($35^3$=42,875) would be required.

Using two hundred sorting bins, during the first pass through the sorter, the mail is sorted according to address, i.e., $A_1$–$A_{200}$. Thus, after the first pass the first bin would contain the mail for the first address on each street, i.e., $S_1$ $A_1$, $S_2$ $A_1$, $S_3$ $A_1$ . . . $S_{200}$ $A_1$. The second bin would contain the mail for the second address on each street, i.e., $S_1$ $A_2$, $S_2$ $A_2$, $S_3$ $A_2$ . . . $S_{200}$ $A_2$. The last bin would contain the mail for $S_1$ $A_{200}$, $S_2$ $A_{200}$, $S_3$ $A_{200}$ . . . $S_{200}$. The stacks would not, however be sorted by street.

In the next pass, the stacks from the bins are sequentially collected and placed in the sorter feeder to be sorted by street. In the second pass, the first stack from the previous pass, containing all of the mail pieces destined for the first address on each street would be sorted as follows: $S_1$ $A_1$ would be diverted into the first bin, $S_2$ $A_1$ would be diverted into the second bin, $S_3$ $A_1$ would be diverted to the third bin . . . and $S_{200}$ $A_1$ would be diverted to the two-hundredth bin. Mail pieces destined for the second address on each street would then be sorted to the bins in the same fashion, followed by mail pieces destined for the third address on each street. This process would be repeated sequentially for each stack from the first pass through the sorter.

Upon completion of the second pass, the previously unsorted stack of mail would be ordered sequentially for delivery. The first bin would contain mail destined for delivery to the first street ($S_1$) by address ($A_1$–$A_{200}$), the second bin would contain mail destined for the second street, ($S_2$) by address ($A_1$–$A_{200}$) with each sequential bin containing mail, ordered by address, for that street. However, although the mail pieces have been ordered, the mail pieces are still in loose stacks. Thus, a carrier receiving the mail pieces for delivery on his/her route is required to sort through and separate the mail for delivery to individual addresses or delivery points.

In a method according to the invention, the number of bins utilized by the sorter is reduced, thereby allowing the use of a smaller sorting machine or increased utilization of an existing machine. Further, the mail is provided to the carrier in bundles in delivery order, alleviating the need for time consuming manual shuffling through stacks of loose mail. In one method according to the invention, these benefits are achieved through the use of an automated sorting machine used in conjunction with a plurality of mail bundling machines and a sorting method in which one or more batches of partially sorted mail are directed from the sorter to a bundling apparatus including a plurality of bundling machines or modules.

Referring now to FIG. 1, a mail sorting machine 10 includes a feeder/singulator 12 where an unordered stack 14 of mail pieces are loaded for sorting. One such feeder is disclosed in copending, commonly assigned U.S. application Ser. No. 09/954,482 and Ser. No. 09/954,483, the disclosures of which are incorporated herein by reference. Feeder 12 singulates and transfers or conveys the mail pieces to a scanner 18 such as a bar code scanner or an optical character recognition (OCR) apparatus. Scanner 18 reads destination information from the mail pieces and transmits the information to a control computer 20 which stores the destination information and identifies the bin 22 where the mail piece is to be directed. Thus, computer 20 contains the destination information and bin location where each mail piece is to be sorted. Further, with this information, computer 20 can determine the order in which the mail pieces will be stacked in each bin. One or more conveyors 16 conveys the mail pieces to a plurality of diverters, (not shown) which divert the mail pieces into bins 22 as directed by computer 20.

In a method according to the invention, after the batch of mail pieces has been sorted with automated sorter 10, the batch is transferred to a bundling apparatus 24 for further processing. Bundling apparatus 24 includes bundling feeder 26, conveyor 28 and a plurality of bundling machines or modules 30. Mail pieces are singulated and fed from feeder 26 to conveyor 28 which is provided with a plurality of diverters 32 that direct mail pieces from the conveyor into individual bundling modules 30. Conveyor 28 and diverters 32 may be of the same type utilized in known conventional delivery bar code sorting machines (DBCS) and similar devices. In one embodiment, bundling apparatus 24 also includes a second scanner 34, which may be a bar code scanner or optical character reading apparatus.

Bundling modules 30 may be any known bundling apparatus suitable for fastening individual mail pieces together in bundles. Such known bundling machines include wrapping devices that bundle the mail pieces by wrapping the mail pieces with a thin polymer film. It is contemplated that other bundling apparatus, using elastic or inelastic cords, straps, strings or similar means may be used to bundle the mail pieces. It is further contemplated that the bundling machine may comprise a bagging machine wherein the mail pieces are bundled by bagging the mail pieces in individual plastic or paper bags, depending upon the particular design and application. In this aspect, it would be desirable to utilize a thin, transparent plastic bag, enabling the carrier to view the contents of the bag. However, insofar as the particular machine or apparatus utilized to bundle the mail pieces does not constitute an essential feature of the method, any suitable means for collecting and bundling together mail pieces destined for delivery to a single location may be utilized in the practice of the invention.

In one method according to the invention, a batch of mail pieces $M_1$, $M_2$, $M_3$. . . $M_n$ is addressed to a plurality of destinations $A_1, A_2, A_3, \ldots A_n$ corresponding to a defined set of destinations such as the destinations served by a local post office is processed for delivery. For the purpose of illustration, it is assumed that the local post office serves 40,000 addresses. The mail pieces are loaded on feeder 12, singulated and directed through scanner 18 which reads scanned destination indicia from the mail pieces and transmits the information to computer 20. Computer 20 assigns each mail piece to a bin and creates a record for each mail piece including the destination information for the letter. With this information, computer 20 can thus determine the sequence that the mail pieces will be in after the mail pieces are sorted in delivery order and how many mail pieces are destined for each delivery point. In order to illustrate the method, it is also assumed that computer 20 assigns each mail piece a five digit numerical sorting code corresponding to the delivery point of the mail piece. The first and second pair of digits range from 1 to 64 and the fifth digit ranges from 0–9. The code is assigned in delivery point order, for example, mail pieces destined for the first delivery point are assigned "01010" and mail pieces addressed to the last delivery point are assigned "64649." The use of such a code may or may not be desirable or advantagous in systems employing a method in accordance with the invention.

In accordance with the method the batch of mail is processed through sorter 10 in a first sorting pass using the first two digits to direct each mail piece to one of sixty-four bins 22. The first bin will receive mail pieces coded 01010 to 01649, the second bin will receive mail pieces coded 02010 through 02649 and the last bin will receive those mail pieces coded 64010 through 64649. The partially sorted mail is then collected from the bins and re-loaded sequentially in order by bin number in feeder 12 for a second pass through the sorter. In the second pass, the mail is sorted by the second pair of digits. After the second pass, the first bin will contain the mail pieces coded 01010 through 64019, the second bin will contain those mail pieces coded 01020 through 64029 and the last bin will contain the mail pieces coded 01640 through 64649, with the mail pieces being in each bin in sequential order by the first two digits. Thus, after the second pass, when the stacks of mail pieces are removed from the bins in sequential order by bin number for transfer to bundling apparatus 24, the mail pieces in the batch are ordered by the first four digits of the sorting code and unordered with respect to the final digit of the sorting code.

After the second pass, an operator collects the stacks of mail from bins 22 and loads the stacks sequentially by bin number in bundling feeder 26. As will be appreciated, the batch of partially ordered mail pieces 38 loaded in bundling sorter 26 requires one additional sort corresponding to the final digit of the sort code to place the mail in delivery order. Computer 20 accomplishes the final sort according to the last digit of the sorting code by signaling diverters 32 to direct the mail pieces to individual bundling machines according to the last digit. For example, mail pieces assigned a sorting code ending in "0" will be sorted to the first bundling machine, mail pieces assigned a sorting code ending in "9" will be diverted to the tenth or last bundling machine. Since the mail pieces have already been sorted by the first four digits of the sorting code, the bundling machines will receive the mail pieces in delivery order as the mail pieces are diverted by diverters 32 from conveyor 28. Further, since computer 20 has a record of each mail piece address to a particular delivery point or address, when all mail pieces addressed to that delivery point have been diverted to a bundling machine 30 computer 20 signals bundling module 30 to bundle the mail pieces and discharge the bundled mail pieces. A suitable conveyor or chute (not shown) may be utilized to receive and transfer the bundled mail pieces discharged from each bundling module 30.

Thus, in a method according to the invention, computer 20 stores a record for each mail piece during a first pass through sorter 10, enabling the computer to determine the order of the mail pieces after each pass through sorter 10 and the number of mail pieces addressed to each delivery point. The record includes destination information for the mail piece such as a Zip+4 or similar code corresponding to the delivery point of the mail piece. Using the stored records, computer 20 determines the sequence in which the mail pieces will be ordered when sorted in delivery order and how many mail pieces are destined for each delivery point. After the required number of passes through the automated sorting machine, the partially sorted mail pieces are transferred manually or mechanically to bundling feeder 26 which feeds the mail pieces in a singulated stream to conveyor 28. Computer 20 utilizes the stored records for each mail piece to control the operation of diverters 32 to direct the mail pieces into bundling modules 30. Alternatively, the mail pieces can be scanned a second time with second scanner 34, the scanned results transmitted to computer 20 and the final sort may be accomplished based upon the results of the second scan of the mail pieces. Further, in one variation, a photocell or similar sensing device (not shown) is used to determine each time a mail piece enters one of bundling modules 30. The signal from the photocell or sensing device is transmitted to computer 20 which records and compares the number of mail pieces diverted to the bundling machine to the number of mail pieces for which have stored a record indicating a particular delivery point. When the number of signals received from the photocell equals the number of stored records indicating a mail piece address to the particular destination, computer 20 signals the bundling module to bundle and discharge those mail pieces and begins the process over again with the next set of mail pieces to be bundled.

In either case, when computer 20 determines that all mail pieces for a given delivery point have been sorted to the selected bundling module, computer 20 signals or activates bundling module 30 which bundles the mail for the particular delivery point or address. Depending upon the cycle time of the bundling modules, computer 20 may be programmed to temporarily stop feeder 26 when one or more bundling modules 30 is in the process of bundling mail, and computer 20 determines that a subsequent mail piece will be directed to that bundling machine before the bundling cycle is completed.

After the mail for that delivery point is bundled, the bundle is discharged from the bundling module and collected by the carrier for delivery on his or her route. Since the mail pieces have been bundled and are ordered by delivery point or address, the mail carrier is not required to "thumb" or sort through a stack of mail pieces to identify and separate mail pieces destined for different addresses. Thus, the method of sorting and bundling set forth herein provides for increased efficiency and reduced cost in mail handling systems.

While one embodiment of the method of the invention has been described in connection with a delivery area or zone comprising 40,000 delivery points or addresses and a sorting and bundling system including a sorting machine using 64 bins and 10 bundling modules it will be appreciated that greater or lesser numbers of passes, bins and bundling modules may be employed in the method. In general, to place a batch of mail in delivery order in a method according to the invention, the number of bins m raised to the power equal to the number of passes p multiplied by the number of bundling modules b must be greater than or equal to the number of delivery points or addresses n or $m^p*b \geqq n$. Thus, as in the above example wherein 10 bundling modules 30 are employed, the number of bins required to place a batch of mail destined for 40,000 delivery points in two passes is equal to the square root of the number of delivery points divided by the number of bundling modules, rounded up to the next whole number or $(40{,}000/10)^{0.5}=63.25$ or 64 bins.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, in some applications, it may not be necessary to employ multiple bundling machines. Small post offices or routes having have a small number of delivery points may require only a single bundling machine. The appended claims are intended to cover and encompass such any such modifications, variations or embodiments.

The invention claimed is:

1. A method for sorting and bundling mail pieces for delivery comprising:

a) sorting a batch of mail pieces each having a destination code thereon which corresponds to one of n predetermined delivery destinations with an automated sorting machine which scans and stores each destination code in a computer memory in at least one pass of the mail pieces through the sorting machine, the automated sorting machine ordering the mail pieces according to a first selected destination criteria to partially sort the batch of mail pieces by destination code;

b) then further sorting the batch of partially sorted mail pieces to a plurality of b bundling machines by destination code, the automated sorting machine sorting the mail pieces to m bins in a plurality of p sorting passes, and wherein the number of bundling machines used to bundle the mail pieces is greater than or equal to n divided by the quantity m raised to the power p, whereupon mail pieces having the same destination code are directed to one of the bundling machines, c) then bundling mail pieces having the same destination code together in one of the bundling machines.

2. The method of claim 1, wherein in step a), the mail pieces are sorted in a plurality of passes through the sorting machine.

3. The method of claim 2, further comprising:

transferring the batch of partially sorted mail pieces from the automated sorting machine to a feeder after the plurality of sorting passes are completed; and feeding the batch of partially sorted mail pieces with the feeder to a conveyor provided with diverters which divert each mail piece to one of the bundling machines.

4. The method of claim 1, wherein in step b) the mail pieces of each batch are sorted using a digit of the destination code.

5. The method of claim 1, wherein the destination code comprises 5 digits, wherein the first two digits of the destination code are used in a first sorting pass in step a), the second two digits of the destination code are used in a second sorting pass in step a), and the last digit is used to sort the batch of mail pieces to a plurality of b bundling machines by destination code.

6. The method of claim 5, wherein b is at least 10.

7. The method of claim 5, wherein the destination code comprises a five digit ZIP code plus additional digits sufficient to identify specific delivery points.

8. The method of claim 7, where the n predetermined delivery destinations are delivery points on a carrier delivery route.

9. The method of claim 8, further comprising delivering the bundled mail to the n delivery points on the carrier delivery route.

10. The method of claim 8, further comprising:

determining a total number of mail pieces in the batch to be delivered to each destination point;

during step b), tracking the number of mail pieces sent to a bundler for a destination point then being sorted to; and when the number of mail pieces sent to a bundler for a destination point then being sorted to equals the total number for that delivery point, operating the bundler to bundle the mail for that delivery point.

11. A method for sorting and bundling mail pieces for delivery comprising:

a) partially sorting a batch of mail pieces each having a destination code thereon which corresponds to one of n predetermined delivery destinations with an automated sorting machine which scans and stores each destination code in a computer memory in at least one pass of the mail pieces through the automated sorting machine, the automated sorting machine sorting the mail pieces to a plurality of sorting bins according to a first destination criteria to partially sort the batch of mail pieces by destination code;

b) transferring the partially sorted batch of mail pieces from the bins to a feeder;

b) separating the batch of partially sorted mail pieces into a singulated stream of individual mail pieces with the feeder;

c) conveying the singulated stream of mail pieces to a plurality of bundling machines;

d) diverting mail pieces that have the same destination code from the singulated stream directly to a selected one of the bundling machines; and e) activating the selected bundling machine to bundle the mail pieces together for delivery when all mail pieces in the batch having the destination code have been diverted to the selected bundling machine.

12. The method of claim 11, wherein in step c) each mail piece in the singulated stream of partially sorted mail pieces is scanned for a destination code.

13. A mail sorting and bundling apparatus for sorting and bundling mail pieces for delivery wherein the mail pieces each have a destination code thereon which corresponds to a predetermined delivery destination comprising:

a mail sorting machine including a feeder for singulating a batch of mail pieces into a singulated stream of individual mail pieces which are sorted by destination code to a series of bins of the sorting machine in one or more sorting passes;

a plurality of bundling machines for bundling mail pieces;

a conveyor for conveying the singulated stream of mail pieces from the mail sorting machine to the bundling machines, the conveyor including a plurality of diverters, the diverters diverting individual mail pieces from the conveyor to a selected one of the bundling machines; and a computer for controlling the operation of said diverters, the computer including program logic to actuate the diverters to divert individual mail pieces having the same destination code to a selected one of the bundling machines.

14. The mail sorting and bundling apparatus of claim 13, further comprising a scanner positioned to scan the delivery codes from the mail pieces in the singulated stream of mail pieces before the mail pieces are conveyed to the diverters.

* * * * *